US006202215B1

(12) United States Patent
Sauter

(10) Patent No.: US 6,202,215 B1
(45) Date of Patent: Mar. 20, 2001

(54) PROTECTIVE CHAPS FOR CONSTRUCTION WORK

(76) Inventor: Adam Garrett Sauter, 2 S. Wickham Ct. #4, Madison, WI (US) 53711

( * ) Notice: Subject to any disclaimer, the term of this patent is extended or adjusted under 35 U.S.C. 154(b) by 0 days.

(21) Appl. No.: 09/585,297

(22) Filed: Jun. 1, 2000

(51) Int. Cl.[7] ..... A41D 13/04
(52) U.S. Cl. ..... 2/51; 2/51
(58) Field of Search ..... 2/51, 46, 22, 24, 2/242, 911, 455, 228, 465, 79, 227; 36/2 R

(56) References Cited

U.S. PATENT DOCUMENTS

| | | | | |
|---|---|---|---|---|
| 952,179 | * | 3/1910 | Beckmann | 2/51 |
| 1,031,054 | * | 7/1912 | Daum | 2/51 |
| 4,697,286 | * | 10/1987 | Cho | 2/22 |
| 4,984,303 | * | 1/1991 | Ross | 2/227 |
| 5,088,116 | * | 2/1992 | Gould | 2/82 |
| 5,095,544 | * | 3/1992 | Elverskog | 2/22 |
| 5,375,262 | * | 12/1994 | Carter | 2/23 |
| 5,517,696 | * | 5/1996 | Krugler | 2/250 |
| 5,584,075 | * | 12/1996 | Kim et al. | 2/455 |
| 5,918,310 | * | 7/1999 | Farahany | 2/23 |

* cited by examiner

*Primary Examiner*—John J. Calvert
*Assistant Examiner*—Tejash Patel

(74) *Attorney, Agent, or Firm*—Craig A. Fieschko, Esq.; DeWitt Ross & Stevens S.C.

(57) ABSTRACT

Protective construction chaps are worn about a worker's waist to extend downwardly from a location just below the worker's abdomen. The chaps cover the fronts of the worker's thighs in substantially form-fitting fashion (even when the worker is bending, walking, or otherwise moving), and terminate at a point slightly above the worker's knees. The chaps include a waist section which extends vertically between an upper edge and an opposing lower portion, and laterally between opposing inner and outer side edges. A pair of leg sections is also included, wherein each leg section extends vertically between a top portion and an opposing bottom edge, and laterally between opposing inner and outer side edges. The top portions of the leg sections are joined to the waist section on opposing sides of its lower portion, with the inner side edges of the leg sections extending from the lower portion of the waist section. As a result, the waist sections and leg sections together have a shape resembling the front of a worker's waist and thighs. The chaps further include one or more waist straps which each extend from one of the side edges of the waist section, and these waist straps may be extended about a worker's waist to be selectively connected to each other or to the waist section to affix the waist section about a worker's waist. Each leg section similarly includes one or more leg straps, wherein each leg strap extends from one of the side edges of its leg section, so that the leg straps on each leg section may be selectively connected to each other or to the leg section to affix each leg section about one of the worker's legs.

20 Claims, 2 Drawing Sheets

PROTECTIVE CHAPS FOR CONSTRUCTION WORK

FIELD OF THE INVENTION

This disclosure concerns an invention relating generally to protective garments, and more specifically to protective garments for construction work.

BACKGROUND OF THE INVENTION

Construction workers must wear a variety of protective gear when working at a construction site. Apart from hard hats and safety glasses, long denim pants are recommended for protecting the worker's legs and feet. Construction work generally results in rapid wear to the front of a worker's pants owing to contact with the work environment (e.g., when working against objects), and also owing to splashing fluids, sparks and debris from cutting and grinding operations, and the tendency of the worker's dirty hands to contact the worker's pants numerous times during the course of a working day. In view of the worker's stance when operating tools and/or working on workpieces, and the manner in which workers generally hold tools when performing such operations, the greatest damage tends to occur to the upper portion of the worker's pants, on the front of the thighs and above the worker's knees.

Some protective wear is known which assists in protecting the worker's upper thighs, and the worker's pants at this region. Work aprons, wherein the apron ties around the worker's waist and dangles down above the worker's upper thighs and groin, are well known. These work aprons often include pockets wherein a worker may carry an array of tools for ready access. However, these work aprons are not in widespread use at construction sites because they are impractical and inconvenient for use when performing most common construction tasks. The aprons generally do not perform a significant protective function because they only cover the worker's front from the waist to the mid-thigh region. They dangle down loosely from the worker's waist, and are therefore subject to lifting or other displacement. This also makes them annoying to wear when walking since the apron bounces up and down on the worker's thighs, an action which is particularly pronounced when the apron bears pockets wherein heavy tools are situated. The work aprons are also annoying to wear while walking because they resist leg movement, with the side of the apron adjacent the forward-stepping leg pulling on the side of the apron adjacent the rearward leg. The constricting nature of the apron is particularly problematic because it makes it difficult for the worker to move fast in situations where speed is needed to avoid injury. The dangling apron can also pose a safety hazard because it easily catches on objects in the surrounding work environment, and it can be pulled into power tools and similar equipment. Additionally, such work aprons are generally made of heavy canvas or similar fabric. Because this fabric is highly porous, it tends to collect dust and grime, and contact with the worker's pants can cause these materials to wear into the worker's pants to a greater degree than if no apron was used at all. The porous nature of the work apron additionally creates a hazard to the worker insofar as it is susceptible to absorption of solvents and flammable materials, which can pose a problem where the worker is exposed to sparks from welding or other activities. The work apron can be worn higher up on the worker's waist to avoid bouncing on the worker's legs, but it will then protect less of the worker's pants, and it can additionally be uncomfortable and can hinder bending over owing to constriction about the abdomen.

It would therefore be desirable to have a protective garment available for construction use which protects the worker's upper thighs (and the worker's pants at this region) from abrasion, flying sparks, and fluids; which does not bounce against the worker's legs, or hinder movement when rapid action is required; and which does not pose a danger of catching against objects in the work area, and/or in power tools or similar equipment.

SUMMARY OF THE INVENTION

The invention, which is defined by the claims set forth at the end of this document, is directed to protective chaps which at least partially alleviate the aforementioned problems. A basic understanding of some of the preferred features of the invention can be attained from a review of the following brief summary of the invention, with more details being provided elsewhere in this document.

The protective chaps include a waist section which extends vertically between an upper edge and an opposing lower portion, and laterally between opposing inner and outer side edges. A pair of leg sections is also included, wherein each leg section extends vertically between a top portion and an opposing bottom edge, and laterally between opposing inner and outer side edges. The top portions of the leg sections are joined to the waist section on opposing sides of its lower portion, with the inner side edges of the leg sections extending from the lower portion of the waist section. As a result, the waist sections and leg sections together have a shape resembling the front of a worker's waist and thighs. The chaps further include one or more waist straps which each extend from one of the side edges of the waist section, and these waist straps may be extended about a worker's waist to be selectively connected to each other or to the waist section to affix the waist section about a worker's waist. Each leg section similarly includes one or more leg straps, wherein each leg strap extends from one of the side edges of its leg section, so that the leg straps on each leg section may be selectively connected to each other or to the leg section to affix each leg section about one of the worker's legs.

The chaps are configured to be worn about a worker's waist in such a manner that they extend downwardly from a location just below the worker's abdomen, covering the fronts of the worker's thighs in substantially form-fitting fashion (even when the worker is bending, walking, or otherwise moving), to terminate at a point slightly above the worker's knees. This can be accomplished by making the waist straps, when connected, at least as long as the lateral width of the waist section, and sizing the height of the chaps (as measured between the upper edge of the waist section and the bottom edges of the leg sections) to be less than approximately 80% of the width of the waist section. Alternatively or additionally, to achieve the desired fit, the leg sections may have lengths (as measured between their top portions and bottom edges) sized to be less than approximately 65% of the width of the waist section.

It is desirable to have the chaps remain in close contact with the worker at all times during work activities, so that they avoid bulging or "tenting" on the worker's body. The chaps can be better maintained against the worker where the leg straps exert both lateral tension on the leg sections about the worker's legs, and also vertical tension on the leg sections towards the leg straps, so that the side edges of the leg sections are closely held against the worker's legs. This can be achieved by providing a filleted juncture between the leg section and the leg straps, as by expanding the width of the leg sections where they join the leg straps (or expanding the width of the leg straps where they join the leg sections). As an example, the width of each leg section may increase as it approaches the attachment with its leg straps so that a section of maximum width is defined at or near the leg straps.

The top of the chaps is also preferably configured so as to minimize interference with the worker when the worker bends over, thereby allowing the worker greater mobility. This goal is furthered where the upper edge of the waist section includes tabs which extend upwardly, and also laterally outwardly from the side edges of the waist section, whereupon the waist straps are attached. Alternatively or additionally, the upper edge of the waist section may curve downwardly between its opposing side edges, thereby having greater height nearer to its side edges. These features help to maintain the upper edge of the waist section slightly below the worker's abdomen when the waist section is affixed about the worker's waist, and situate the waist straps slightly above the worker's buttocks and over the lower back. As a result, the chaps are not constricting to the worker when the worker bends over, making the chaps far more comfortable to wear when the worker is engaged in active work.

It is highly preferable to configure the chaps so that they avoid bunching or binding in the groin, since this can cause considerable discomfort during motion, as well as making the worker uncomfortably hot. To avoid these problems, it is recommended that the chaps define a lateral space above the worker's groin, as by spacing the inner side edges of the leg sections further apart adjacent their top portions than at the heights at which the leg straps are located. Vertical clearance is also preferably provided, with the height of the waist section between the leg sections preferably being less than 25% of the width of the waist section at its lower portion.

The chaps preferably have pockets defined on their surface to allow the worker easy access to tools situated within the pockets. However, since tools borne within pockets on the chaps can hinder mobility, it is preferred that pockets (if any) be provided at locations which are low on the leg sections, most preferably at a height situated below the leg straps and on the worker's lower thigh. This helps to prevent tools or other implements within the pockets from poking into the worker when the worker bends over or is otherwise moving.

Since the chaps are configured to extend from the worker's waist to a point above the worker's knees, common knee guards, which are available separately, may be used in conjunction with the chaps if desired, and their usage will not interfere with the chaps (which may be worn under the knee guards if the knee guards extend upwardly above the knee). The chaps are believed to provide an optimal balance between protection of the worker and his/her pants, and the discomfort and decreased mobility that would result from use of protective wear that covers a greater portion of the worker (e.g., the use of protective overalls or pants which fit over the worker's standard garments).

Further advantages, features, and objects of the invention will be apparent from the following detailed description of the invention in conjunction with the associated drawings.

DETAILED DESCRIPTION OF PREFERRED EMBODIMENTS OF THE INVENTION

Figure 1:
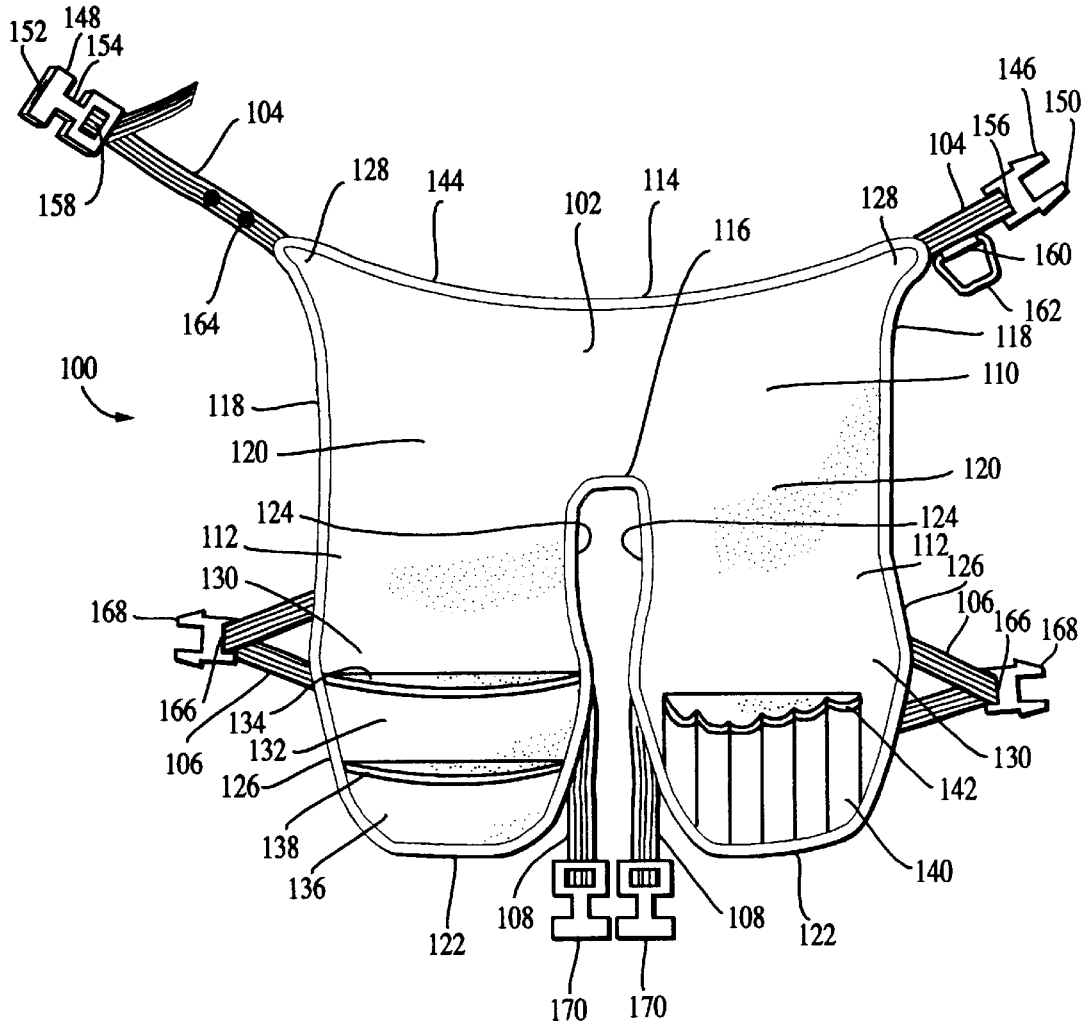
FIG. 1 is a plan view of a first preferred version of protective chaps constructed in accordance with the invention, shown spread into a flat state.

Referring to FIG. 1, a first and particularly preferred embodiment of the protective chaps is designated generally by the reference numeral 100. The chaps 100 have three main components: a body section 102, which is used to cover a portion of the front of the worker's waist and upper thighs; waist straps 104, which affix the body section 102 about a worker's waist; and outer leg straps 106 and inner leg straps 108, which affix the body section 102 about a worker's legs. The body section 102 and straps 104, 106, and 108 will now be discussed in turn.

The body section 102, which is preferably integrally formed of a single continuous piece of material having characteristics which will be discussed later in this document, may be characterized as having three main subcomponents: a waist section 110, and a pair of leg sections 112 which descend beneath the waist section 110. The waist section 110 has a height measured vertically between an waist section upper edge 114 and an opposing waist section lower portion 116, and a width measured laterally between opposing waist section side edges 118. The leg sections 112 each have a length measured vertically between a leg section top portion 120 and an opposing leg section bottom edge 122, as well as a width measured laterally between a leg section inner side edge 124 and an leg section outer side edge 126. The leg section top portions 120 are joined to the waist section 110 on opposing sides of its waist section lower portion 116, with the leg section inner side edges 124 extending from the waist section lower portion 116. Additionally, the leg section outer side edges 126 of the leg sections 112 preferably extend continuously upwardly in a substantially vertical direction to continuously join with the waist section side edges 118 of the waist section 110.

Looking to the waist section 110, at its top corners where the waist section upper edge 114 joins the waist section distal side edges 118, tabs 128 preferably extend laterally outwardly from the waist section side edges 118, and also slightly vertically upwardly from the waist section upper edge 114. The tabs 128, which are connected to the waist straps 104 by stitching or other forms of attachment, are advantageously oriented in this fashion because tension on the waist straps 104 will thereby exert force on the tabs 128 (and thus on the waist section 110) in both laterally outward and vertically upward directions. Particularly where the material of the body section 102 is heavier and thus has some degree of rigidity, the upward and lateral force exerted on the tabs 128 will help to better maintain a greater portion of the height of the body section 102 (as measured from the waist section upper edge 114 to the leg section bottom edge 122) more closely against the worker's body, and will assist in preventing the body section 102 from bulging or ballooning outward about the worker's waist or thighs. Additionally, the upward orientation of the tabs 128 tends to direct the waist straps 104 upwardly above the worker's buttocks and over the worker's lower back, which helps to better allow the waist straps 104 to retain the waist section 110 about the worker's body. Further, placement of the waist straps 104 at this area provides for a more comfortable fit for the worker, without the waist straps 104 digging into the worker's body when bending, squatting, and performing other activities.

Between the opposing waist section side edges 118 (and the tabs 128), the waist section upper edge 114 preferably has an arcuate shape whereby it curves downwardly between its opposing waist section side edges 118. The waist section 110 thereby has minimum height above the waist section lower portion 116 and between the leg sections 112, and greater height as it proceeds towards its waist section side edges 118. As a result, the waist section upper edge 114 curves downwardly below the worker's abdomen, and has lesser tendency to interfere with bending when the worker is performing various tasks about the worksite.

Turning to the leg sections 112, it was previously noted that the body section 102 is preferably formed of a single continuous piece of material; thus, the leg sections 112 will integrally and continuously extend downwardly from the waist section 110. The leg sections 112 are desirably uniquely shaped to help them remain close against the worker's body without bulging, which might hinder movement and/or present protruding edges which can catch on objects about the worksite. Initially, at a region which is preferably situated halfway along the length of the leg sections 112 (or beneath this region), the leg sections 112 have a maximum width section 130 wherein the lateral width of the leg sections 112, between their leg section inner side edges 124 and leg section outer side edges 126, is slightly greater than at other areas along the length of the leg sections 112. The width of the leg sections 112 decreases continuously between the maximum width section 130 and each of the leg section top portion 120 and leg section bottom edge 122. The leg section inner side edges 124 and leg section outer side edges 126 preferably have a smooth and continuous transition between the leg section top portion 120, the maximum width section 130, and the leg section bottom edge 122, i.e., the side edges 124 and 126 do not suddenly and discontinuously protrude outwardly at the maximum width section 130.

The leg straps 106 and 108 are then affixed to the leg sections 112 at their maximum width sections 130 to extend laterally outwardly from the leg section inner side edges 124 and leg section outer side edges 126 to affix the leg sections 112 about a worker's upper thighs. Since the widths of the leg sections 112 between their side edges 124 and 126 continuously increase as they approach the leg straps 106/108, the leg section side edges 124 and 126 effectively define a filleted juncture between the leg straps 106 and 108 and the leg sections 112. As a result, the tension exerted by the leg straps 106/108 on the leg sections 112 is exerted both laterally and vertically on the leg sections 112, thereby allowing the leg straps 106 and 108 to better maintain the leg sections 112 closely about the worker's thighs. In particular, the portions of the leg sections 112 situated vertically below the maximum width section 130 and the leg straps 106 and 108 are maintained closely against the worker's thighs, and are prevented from flapping or bouncing up and down when the worker walks.

Above the maximum width sections 130, the inner side edges 124 of the leg sections 112 curve laterally outwardly to define greater space between the inner side edges 124 adjacent the leg section top portions 120 and waist section lower portion 116. As a result, a larger open area is defined over the worker's crotch, which makes the chaps 100 cooler and more comfortable to wear, and it can additionally allow the worker to use the restroom without having to remove the chaps 100.

Preferably, at least one of the leg sections 112 has pockets, tool-hanging loops, and/or other compartments or fixtures for securing tools on the leg sections 112 for the worker's easy access. It is expected that these pockets, etc. will generally not be formed integrally with the body section 102, but will instead be formed of separate pieces of material which may be sewn or otherwise affixed to the body section 102. Referring to FIG. 1, different types of pockets are shown provided on the leg sections 112: a deep pocket 132 having an upper edge 134 extending between the leg section inner and outer side edges 124 and 126 at the maximum width section 130, with the pocket 132 having a depth extending between the maximum width section 130 and the leg section bottom edge 122; a shallow pocket 136, which has an upper edge 138 situated beneath the upper edge 134 of the deep pocket 132, and which extends atop the deep pocket 132 between the leg section inner and outer side edges 124 and 126; and an array of narrow pockets 140 situated side-by-side across the width of one of the leg sections 112 for receiving pencils, pliers, and other elongated narrow tools. Most preferably, all pockets are situated on the leg sections 112 at heights below the leg straps 106 and 108 and the maximum width sections 130 of the leg sections 112. By situating the pockets lower on the leg sections 112, the tools are situated near the worker's lower thigh, and tools protruding out of the tops of the pockets are less likely to poke or otherwise injure the worker's abdomen when the worker bends over.

About the perimeter of the body section 102, and at the upper edges 134, 138, and 142 of the pockets 132, 136, and 140, edging 144 is preferably attached to the chaps 100 so as to prevent fraying, and to better protect the chaps 100 from ripping in the event its edges are caught on objects in the work area. The edging 144 is preferably provided by a strip of material which is folded over the edges of the body section 102 and the pockets 132, 136, and 140, and then sewn or otherwise affixed thereon. The edging 144 can instead be provided by rows of stitching or other means of reinforcement.

As previously noted, the waist straps 104 are affixed to the waist section 110 at the tabs 128, preferably by affixing them to the rear surface (not shown) of the waist section 110 by stitching or other forms of attachment. The waist straps 104 could instead be affixed to the front of the waist section 110, but this is not preferred because the attached ends of the waist straps 104 will provide a discontinuity in the front surface of the waist section 110 and make it more prone to catching on objects. The waist straps 104 extend from the waist section 110 to terminate in connectors, more specifically a male connector 146 and also a female connector 148 which may releasably engage the male connector 146 therein. The male and female connectors 146 and 148 illustrated in FIG. 1 are of a known type wherein the male connector 146 is furcated to define two protruding and resiliently flexible male connector prongs 150. The male connector prongs 150 flex inwardly towards each other when inserted within a insertion aperture 152 in the female connector 148, and when sufficiently inserted, they then flex back outwardly to be received in a pair of opposing side apertures 154. To disconnect the male and female connectors 146 and 148, the prongs 150 may be pressed inwardly at the side apertures 154 of the female connector 148 and withdrawn from the insertion aperture 152. The waist strap 104 connected to the male connector 146 extends through a strap receiving aperture 156 in the male connector 146, and is then reattached to the length of the waist strap 104. Thus, the male connector 146 is affixed within a loop in the waist strap 104. The length of the waist strap 104 between the waist section 110 and the male connector 146 is preferably relatively short so that the male connector 146 is located at the side of the worker's body, or slightly towards the worker's back, when the chaps 100 are worn by a worker. As a result, the male connector 146 is easily reached by the worker for manipulation. In contrast, the waist strap 104 between the waist section 110 and the female connector 148 is provided with greater length, and its length with respect to the female connector 148 is made adjustable by providing two or more strap apertures 158 in the female connector 148. The waist strap 104 may be interwoven through the various strap apertures 158 to retain the female connector 148, and this allows the worker to adjust the location of the female connector 148 on the waist strap 104 as desired.

The waist strap 104 may bear fixtures which enhance its utility to workers, and exemplary fixtures are illustrated in FIG. 1. Adjacent the male connector 146, a loop 160 is affixed to the waist strap 104, and an attachment ring 162 is mounted to the waist strap 104 through this loop 160. A worker may hook tools to the attachment ring 162 at the side of his/her body for easy access. On the length of the waist strap 104 adjacent the female connector 148, eyelets 164 are embedded within the waist strap 104 to allow other tools or implements to be affixed to the waist strap 104 adjacent the side of the worker's body.

Turning to the leg straps 106 and 108, as previously noted, these are preferably affixed at the rear surface (not shown) of the leg sections 112, and at or adjacent to the maximum width sections 130 of the leg sections 112. As with the waist straps 104, the leg straps 106 and 108 could alternatively be affixed to the front of the body section 102 (more specifically to the fronts of the leg sections 112), but this is not preferred owing to the possibility that the leg straps 106 and 108 might provide an outwardly-protruding edge which is prone to catching on objects in the worksite.

Each outer leg strap 106 is preferably attached to its leg section 112 in such a manner that a significant portion of the length of its leg sections 112 is pulled rearwardly by the leg strap 106, to be held closely about the worker's thigh. In the chaps 100, this is effected by having the outer leg strap 106 extend outwardly from the leg section outer side edge 126 from a location slightly above the maximum width section 130, and then through a strap receiving aperture 166 in a male connector 168. The outer leg strap 106 is then folded beneath the male connector 168 to extend slightly below the maximum width section 130, where it reattaches to the leg section outer side edge 126. Since the outer leg s trap 106 is affixed to spaced points on the leg section outer side edge 126, tension on the outer leg strap 106 will be exerted along the length of the leg section 112 between which the ends of the outer leg strap 106 are attached. At the same time, the male connector 168 may slide along the length of the outer leg strap 106 to a position which minimizes tension in the outer leg strap 106. This allows for a greater comfort in the fit of the leg straps 106 a bout the worker's upper thigh, and also helps to keep the leg sections 116 from tenting or bulging about the worker's upper thigh. The inner leg straps 108 t hen extend from the maximum width section 130 of the leg section 112, and slidably bear female connectors 170 thereon so that the female connectors 170 may be repositioned along the length of the inner leg straps 108 for maximum comfort.

The body section 102 is preferably made of stain-retardant, fast-drying, lightweight, and breathable material, such as the nylon material sold under the trademark CORDURA from DuPont (Wilmington, Del. USA). The straps 104, 106, and 108 are preferably a made of a woven synthetic material having similar properties, with the weave being sufficiently coarse that a small degree of elasticity is provided in the straps.

As previously noted, the chaps 100 are intended to be worn about a worker's waist in such a manner that they extend downwardly from a location just below the worker's abdomen, covering the fronts of the worker's thighs in substantially form-fitting fashion (even when the worker is bending, walking, or otherwise moving) and terminating at a point slightly above the worker's knees. In order to fit the worker in this fashion, the chaps 100 preferably have the configuration previously described. Chaps 100 having the following dimensions, and the characteristics previously described, will fit the average worker in the desired fashion:

- initially, the waist straps 104, when fit about the worker's waist, should have a combined length which is at least as great as the lateral width of the waist section 110 between its waist section side edges 118;
- a waist section 110 width between the waist section side edges 118 of approximately 21 inches;
- a waist section 110 minimum height between the waist section upper edge 114 and the lower waist section 116 of approximately 4 inches;
- leg section 112 lengths between the leg section top portion 120 and leg section bottom edge 122 of 12 inches;
- a leg section width 112 at the maximum width section 130 of approximately 10 inches;
- a leg section 112 width adjacent the leg section bottom edge 122 of 7 inches;
- a leg section 112 width adjacent the leg section top portion 120 of approximately 9 inches;
- and the tabs 128 each extending upwardly from the lowest point of the waist section upper edge 114 by approximately 3 inches, and outwardly from the waist section side edges 118 by approximately 1 inch.

It is more constructive to think of the dimensions of the chaps 100 in terms of their "aspect ratio", that is, their dimensions with respect to a datum dimension (which in this case will be the width of the waist section 110):

- the waist section 110 minimum height between the waist section upper edge 114 and the lower waist section 116 is preferably approximately 20% or less of the waist section 110 width;
- the leg section 112 lengths between the leg section top portion 120 and leg section bottom edge 122 is preferably approximately 60% or less of the waist section 110 width;
- the leg section width 112 at the maximum width section 130 is preferably approximately 45% or more of the waist section 110 width;
- the leg section 112 width adjacent the leg section bottom edge 122 is preferably approximately 33% or more of the waist section 110 width; and
- the leg section 112 width adjacent the leg section top portion 120 is preferably approximately 40% or more of the waist section 110 width.

Figure 2:
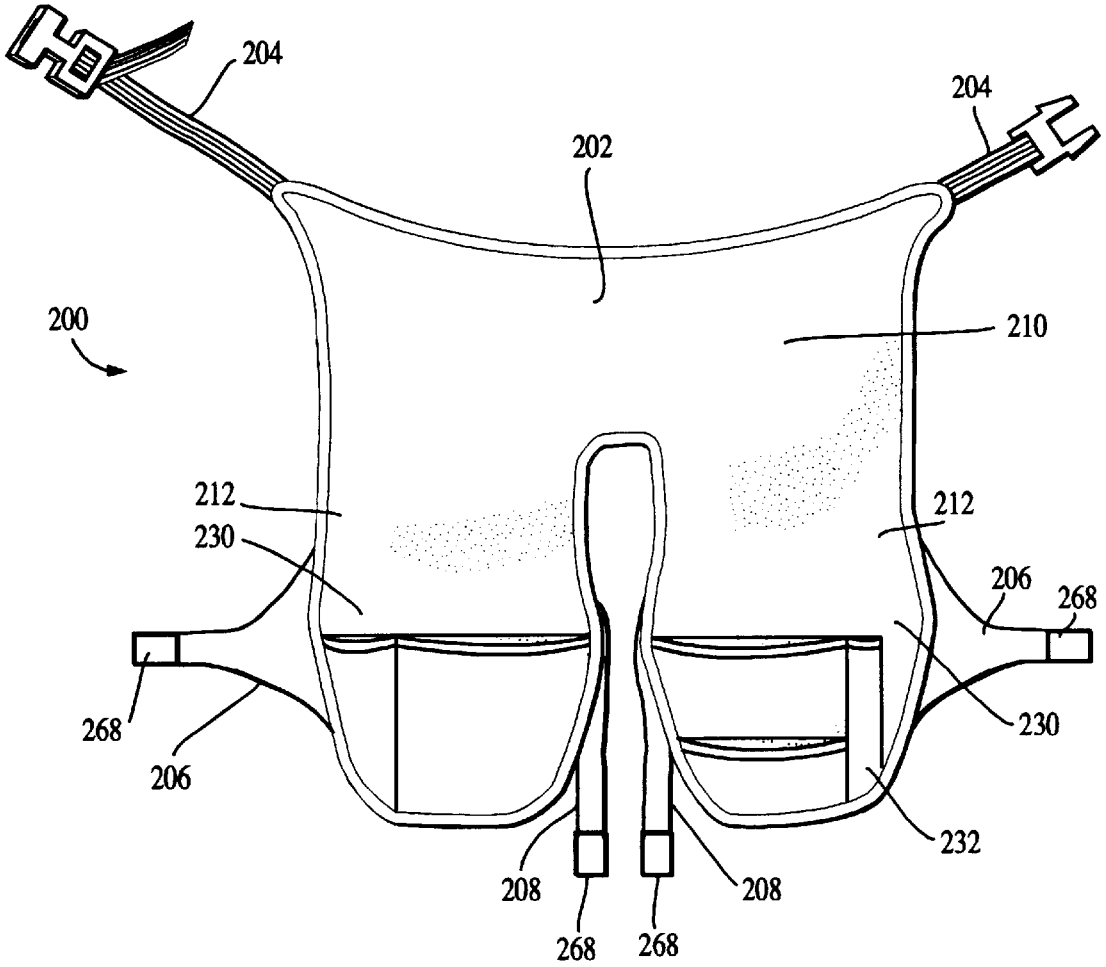
FIG. 2 is a plan view of a second preferred version of protective chaps constructed in accordance with the invention, shown spread into a flat state.

FIG. 2 then illustrates an alternative version of the protective chaps, designated by the reference numeral 200. The chaps 200 are similar to the chaps 100, and include a body section 202, waist straps 204, and outer leg straps 206 and inner leg straps 208. The body section 202 includes a waist section 210 and a pair of leg sections 212 which descend beneath the waist section 210, both of which are configured as in the chaps 100. However, there are two primary differences between the chaps 200 and the chaps 100.

First, the outer leg straps 206 and inner leg straps 208 are each made of elastic material which is stitched or otherwise connected to the maximum width sections 230 of the leg sections 212, and they terminate in leg strap connectors 268 formed of hook-and-loop fastener material. The widths of the outer leg straps 206 expand as they extend to join the leg sections 212 so that they provide a filleted juncture between the outer leg straps 206 and the leg sections 212. Therefore, tension in the outer leg straps 206 will be exerted both laterally and vertically on the leg sections 212 when fit about a worker's thighs so that they will not bulge, and the leg sections 212 will instead remain closely wrapped about the worker's thighs about the entireties of their lengths. As an alternative, the outer leg straps 206 and inner leg straps 208 could be made of an inflexible material such as neoprene. In this case, since the straps 206/208 will not automatically stretch to fit the leg, the connectors 268 could simply be fastened together by the worker with the straps at the appropriate length to provide a comfortable, form-fitting engagement of the leg sections 212 about the worker's thighs. Alternatively, only one of the outer leg straps 206 and inner leg straps 208 could be made of an inflexible material, and the other could be made of an elastic material.

Second, a different arrangement of pockets 232 is illustrated. It should be apparent that a wide variety of pocket arrangements may be provided on the chaps 100 and 200; as previously noted, it is believed advantageous to place pockets at least halfway down the length of the leg sections 112 and 212, below the maximum width sections 130/230 and leg straps, since higher placement of pockets can hinder the worker's bending when the pockets bear tools therein.

It is understood that the various preferred embodiments are shown and described above to illustrate different possible features of the invention and the varying ways in which these features may be combined. Apart from combining the different features of the above embodiments in varying ways, other modifications are also considered to be within the scope of the invention. Following is an exemplary list of such modifications.

First, it should be understood that the chaps 100, chaps 200, and other chaps defined by the claims need not necessarily include two waist straps 104/204, nor must they include both outer leg straps 106/206 and inner leg straps 108/208. Instead, only a single waist strap extending from one side of the waist section could be used, with the single waist strap extending about the worker's body and connecting to the opposite side of the waist section. Similarly, each leg section might bear only a single inner or outer leg strap extending from one side of the leg section, with the single leg strap extending about the worker's leg and connecting to the opposite side of the leg section.

Second, the chaps could, if desired, include more than one set of leg straps on each leg section, with the leg straps located at different points along the length of the on the leg sections. Multiple leg straps might better ensure that the leg sections will remain closely wrapped about the fronts of the worker's legs, though this arrangement is not believed necessary to achieve this goal if the chaps are constructed in the manner previously described. Similarly, the chaps could include more than one set of waist straps on the waist section, with the waist straps located at different heights on the waist section.

Third, the waist straps 104 and leg straps 106 and 108 could be integrally formed with the body section 102, with the connectors 146/148 and 168/170 then being adjustably situated on the waist straps 104 and leg straps 106 and 108 so that they may be repositioned as desired. However, integral formation of the straps 104/106/108 with the body section 102 will not allow the sliding connector arrangement used with the outer leg strap 106 in FIG. 1, nor will it allow the material of the straps 104/106/108 to be different from that of the body section 102 (e.g., elastic as opposed to inelastic, as in the straps 206 and 208 in FIG. 2).

Fourth, in the chaps 100, the chaps 200, and in other versions of the invention, connectors other than the male and female connectors and the hook-and-loop connectors illustrated in the drawings may be utilized. Such connectors may include buckles, ties, snaps, buttons, or other male members which are received within corresponding female members.

Fifth, while the configuration of the chaps as previously described is particularly preferred, it should be understood that the waist section and/or leg sections could be configured differently. As an example, the waist section may be made laterally wider so as to cover the sides of the worker's body and/or the worker's back, and/or the leg sections may be made laterally wider so as to cover the sides and/or backs of the worker's legs. Such configurations are not believed essential, since the chaps as previously described are believed to provide an optimal balance between protection of the worker and his/her pants and the disadvantages that arise from additional leg and/or waist coverage (e.g., bulk, decreased mobility, increased heat and discomfort). However, for some applications, modifications to the configuration of the chaps may be desirable.

Sixth, the reinforced edging 144 could, if desired, bear thin-gauge wire therein to provide a partial degree of rigidity and shape memory about the perimeter of the body section 102 and/or pockets 132, 136, and 140, but which will still provides sufficient flexibility that the chaps will bend to conform with the worker's motion. The rigidity added to the edging will function to help hold the body section closely against the worker's body owing to the tension in the waist straps 104 and leg straps 106 and 108.

The invention is not intended to be limited to the preferred embodiments described above, but rather is intended to be limited only by the claims set out below. Thus, the invention encompasses all alternate embodiments that fall literally or equivalently within the scope of these claims.

What is claimed is:

1. Protective chaps comprising:

a. a waist section having (1) a height measured vertically between an upper edge and an opposing lower portion, and (2) a width of the chaps measured laterally between opposing side edges;

b. a pair of leg sections, each leg section having (1) a length measured vertically between a top portion and an opposing bottom edge, and (2) a width measured laterally between opposing inner and outer side edges;

wherein the top portions of the leg sections are joined to the waist section on opposing sides of its lower portion, with the inner side edges of the leg sections extending from the lower portion of the waist section;

c. one or more waist straps, each waist strap extending from one of the side edges of the waist section and being selectively connectable to define a closed loop in combination with the waist section, whereby the waist section may be selectively secured about a worker's waist;

d. each leg section including one or more leg straps, each leg strap extending from one of the side edges of its leg section and being selectively connectable to define a closed loop in combination with its leg section, whereby its leg section may be selectively secured about a worker's leg;

wherein:

the waist straps, when connected with the waist section secured about the worker's waist, have a length which is at least as long as the width of the waist section, and the length of each leg section is less than 65% of the width of the waist section, whereby the bottom edge of each leg section rests above the worker's knee when the waist section is secured about a worker's waist.

2. The protective chaps of claim 1 wherein the height of the chaps between the upper edge of the waist section and the bottom edges of the leg sections is less than 80% of the width of the waist section, whereby the bottom edge of each leg section rests above the worker's knee when the waist section is secured about a worker's waist.

3. The protective chaps of claim 1 wherein the upper edge of the waist section curves downwardly between its opposing side edges, the waist section thereby having greater height nearer to its side edges.

4. The protective chaps of claim 1 wherein the width of each leg section is greatest at a maximum width section situated at a height between the leg section's top portion and its bottom edge, with the width of the leg section decreasing continuously between the maximum width section and each of the top portion and the bottom edge.

5. The protective chaps of claim 4 wherein the inner side edges of the leg sections curve outwardly above their maximum width sections, thereby defining greater space between the inner side edges of the leg sections adjacent their top portions.

6. The protective chaps of claim 1 wherein each leg section increases in width adjacent to the leg straps, its side edges thereby defining a filleted juncture between the leg section and the leg straps.

7. The protective chaps of claim 1 wherein at least one of the leg sections has one or more pockets defined therein, the pockets being situated at a height below the leg straps.

8. The protective chaps of claim 1 wherein at least one of the leg sections each has a pocket defined therein, the pocket being located below a height located approximately halfway between the top portion and the bottom edge of the leg section.

9. The protective chaps of claim 1 wherein the inner side edges of the leg sections are spaced further apart adjacent their top portions than at heights at which the leg straps are located, thereby defining greater space between the inner side edges of the leg sections adjacent their top portions.

10. The protective chaps of claim 1 wherein the height of the waist section between the leg sections is less than 25% of the width of the waist section at its lower portion.

11. The protective chaps of claim 1 wherein the upper edge of the waist section includes tabs extending therefrom adjacent the side edges of the waist section, with the tabs extending laterally outwardly from the side edges and upwardly from the upper edge, and wherein the waist straps are each affixed to one of the tabs.

12. Protective chaps comprising:

a. a waist section having
(1) a height measured vertically between an upper edge and an opposing lower portion, and
(2) a width of the chaps measured laterally between opposing side edges;

b. a pair of leg sections, each leg section having
(1) a length measured vertically between a top portion and an opposing bottom edge, and
(2) a width measured laterally between opposing inner and outer side edges;

wherein the top portions of the leg sections are joined to the waist section on opposing sides of its lower portion, with the inner side edges of the leg sections extending from the lower portion of the waist section;

c. one or more waist straps, each waist strap extending from one of the side edges of the waist section and being selectively connectable to define a closed loop in combination with the waist section, whereby the waist section may be selectively secured about a worker's waist;

d. each leg section including one or more leg straps, each leg strap extending from one of the side edges of its leg section and being selectively connectable to define a closed loop in combination with its leg section, whereby its leg section may be selectively secured about a worker's leg;

wherein:

the waist straps, when connected with the waist section secured about the worker's waist, have a length which is at least as long as the width of the waist section, and the height of the chaps between the upper edge of the waist section and the bottom edges of the leg sections is less than 80% of the width of the waist section, whereby the bottom edge of each leg section rests above a worker's knee when the waist section is secured about the worker's waist.

13. The chaps of claim 12 wherein the upper edge of the waist section curves downwardly between its opposing side edges, thereby having greater height nearer to its side edges.

14. The chaps of claim 12 wherein the side edges of each leg section extend outwardly adjacent to its leg straps to expand its width, the side edges thereby defining a filleted juncture between the leg section and its leg straps.

15. The chaps of claim 12 wherein at least one of the leg sections each has a pocket defined therein, the pocket being located below a height located approximately halfway between the top portion and the bottom edge of the leg section.

16. The chaps of claim 12 wherein the inner side edges of the leg sections are spaced further apart adjacent their top portions than at heights at which the leg straps are located, thereby defining greater space between the inner side edges of the leg sections adjacent their top portions.

17. Protective chaps comprising:

a. a waist section having
(1) a height measured vertically between an upper edge and an opposing lower portion, and
(2) a width of the chaps measured laterally between opposing side edges;

b. a pair of leg sections, each leg section having
(1) a length measured vertically between a top portion and an opposing bottom edge, and
(2) a width measured laterally between opposing inner and outer side edges;

wherein the top portions of the leg sections are joined to the waist section on opposing sides of its lower portion, with the inner side edges of the leg sections extending from the lower portion of the waist section;

c. one or more waist straps, each waist strap extending from one of the side edges of the waist section and being removably connectable to at least one of:
(1) the opposing side edge of the waist section, and
(2) another waist strap, if more than one waist strap is provided;

d. each leg section having one or more leg straps, each leg strap extending from one of the side edges of its leg section and being removably connectable to at least one of:

(1) the opposing side edge of its leg section, and (2) another leg strap, if more than one leg strap is provided;

wherein:

the inner side edges of the leg sections are spaced further apart adjacent their top portions than at heights at which the leg straps are located, thereby defining greater space between the inner side edges of the leg sections adjacent their top portions; and the height of the waist section between the leg sections is less than 25% of the width of the waist section at its lower portion.

18. The protective chaps of claim 17 wherein the height of the chaps between the upper edge of the waist section and the bottom edges of the leg sections is less than 80% of the width of the waist section, whereby the bottom edge of each leg section rests above a worker's knee when the waist section is secured about the worker's waist.

19. The protective chaps of claim 18 wherein the length of each leg section is less than 65% of the width of the waist section, whereby the bottom edge of each leg section rests above the worker's knee when the waist section is secured about the worker's waist.

20. The protective chaps of claim 17 wherein the upper edge of the waist section curves downwardly between its opposing side edges, thereby having greater height nearer to its side edges.

* * * * *